United States Patent [19]

Friedman

[11] Patent Number: 4,718,557

[45] Date of Patent: Jan. 12, 1988

[54] EASY OPENING, RECLOSABLE CARTON

[75] Inventor: Herbert Friedman, Fort Lee, N.J.

[73] Assignee: Ivy Hill Corporation, New York, N.Y.

[21] Appl. No.: 34,415

[22] Filed: Apr. 3, 1987

[51] Int. Cl.[4] ..... B65D 5/72

[52] U.S. Cl. ..... 206/621.3; 229/149; 229/122.2

[58] Field of Search ..... 206/621.3, 621, 621.5, 206/621.6; 229/122, 123.2, 123.3, 166.2, 124, 126, 127, 132, 149, 147, 148, 150, 17 R, 7 R, 122.2

[56] References Cited

U.S. PATENT DOCUMENTS

| | | | |
|---|---|---|---|
| 1,553,752 | 9/1925 | Cooper | 229/17 R |
| 3,181,767 | 5/1965 | Starkey | 229/17 R |
| 3,185,374 | 5/1965 | Feeney | 229/17 R |
| 3,262,630 | 7/1966 | Koolnis | 229/17 R |
| 3,270,941 | 9/1966 | Barnes | 229/17 R |
| 3,270,945 | 9/1966 | Whitaker et al. | 206/621 |
| 3,372,853 | 3/1968 | Rumberger | 229/17 R |
| 3,395,848 | 8/1968 | Johnson | 229/17 R |
| 3,426,955 | 2/1969 | Olson | 229/17 R |
| 3,549,082 | 12/1970 | Simpson | 206/621 |
| 3,578,234 | 5/1971 | Marchisen | 229/17 R |
| 3,606,133 | 9/1971 | Meyers | 229/7 R |
| 3,897,900 | 8/1975 | Gorski | 229/17 R |
| 4,019,673 | 4/1977 | Salomons | 229/17 R |
| 4,122,948 | 10/1978 | Grieve et al. | 229/17 R |
| 4,142,635 | 3/1979 | Capo et al. | 206/622 |
| 4,168,003 | 9/1979 | Wysocki | 206/611 |
| 4,412,236 | 12/1983 | Lowe | 206/621 |
| 4,548,318 | 10/1985 | Boyle | 206/621 |

*Primary Examiner*—Willis Little

*Attorney, Agent, or Firm*—Amster, Rothstein & Ebenstein

[57] ABSTRACT

An easy open, reclosable carton is disclosed as well as a blank from which the carton can be formed. The structure incorporating the easy open feature is not disposed in an exposed outer surface of the carton. A major end panel of the carton includes a weakened region which is covered by a minor end panel. The minor end panel is unsealed and opened to expose the weakened region, which may then be partially or fully severed from the major end panel to form an opening into the carton though which product may be removed from the carton. The reclosable feature is provided by a tab on the minor end panel which engages a slit in the major end panel.

43 Claims, 14 Drawing Figures

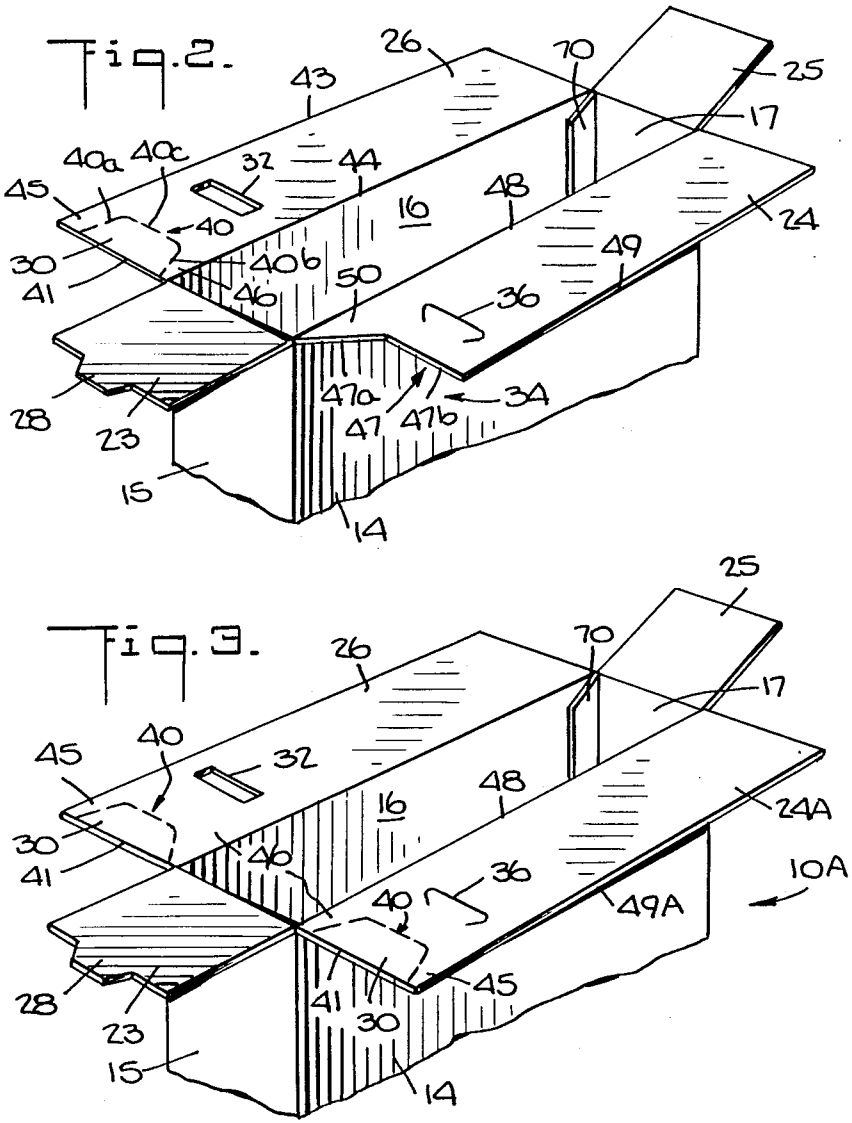
Fig. 2.
Fig. 3.
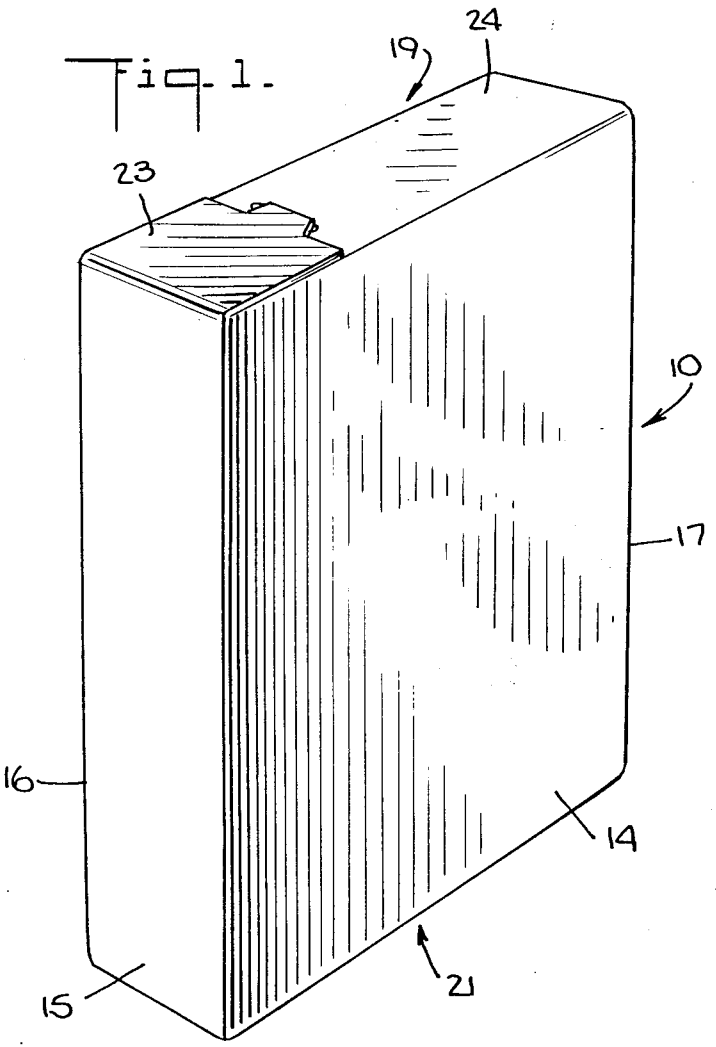
Fig. 1.

EASY OPENING, RECLOSABLE CARTON

BACKGROUND OF THE INVENTION

The invention disclosed herein relates generally to easy opening cartons and to easy opening, reclosable cartons, and more particularly to easy opening, paperboard folding cartons which may be reclosed after opening, and to blanks from which such cartons are made.

A desirable feature for cartons in general is the capability of opening the cartons easily. Because cartons usually have to function as packaging to maintain product integrity during shipping, handling and sale, it has been difficult to make easy opening cartons which are not substantially weakened by the introduction of the structure which makes the cartons easy to open, or, on the other hand, to make easy opening cartons which are substantially unweakened and are still easy to open.

Another desirable feature for many cartons, particularly those which contain products in multiple use or multiple serving quantities, is the capability of reclosing the cartons after opening so as to protect the product remaining in the cartons from spillage or contamination, or to maintain product freshness. Many cartons today incorporate structure providing both the easy opening and reclosable features. In such cartons, the difficulty associated with making a strong easy opening carton is compounded by the need to incorporate the structure which provides the reclosable feature. Therefore, many cartons, particularly cartons used for dry pourable products such as rice, soap powders, cereals and other products, which incorporate both features are not entirely satisfactory as to strength, easy opening and/or reclosing, or incorporate both features with complicated and/or expensive blanks and carton erection processes.

One carton system in wide use today for rice and soap powders, for example, includes full width major top end panels or flaps which are fully glued to each other, and structure in one of the minor side panels near the carton top which is intended to be penetrated or torn to provide a reclosable opening. In that type of system, perforations extending in the shape of a U or V are provided on the minor side panel immediately below the top of the carton. To open the carton, a force is applied to sever the portion of the minor side panel defined by the perforations, and the severed portion is pulled back over the carton top. Since a weakened region defined by the perforations exists on an exterior surface of the carton, the weakened region must be made strong enough to resist tearing during shipping and handling, and consequently, cartons including such perforations are still relatively strong and difficult to open. Another disadvantage in this type of carton system where the pouring opening is formed in the carton side, is that the pouring opening is not usually visible during pouring, resulting in so-called "blind pouring".

In another carton system in wide use today for pourable products such as dishwasher soap powders, for example, the carton includes a pull-down metal pouring spout in a minor side panel of the carton adjacent the top end thereof. The carton, including the spout, is covered by a full overwrap, or the spout is covered and maintained closed during shipping, handling and sale by a pressure sensitive tape. To open such cartons, the overwrap covering the spout is torn or the tape covering the spout is removed, and the spout is pulled down.

To reclose the carton, the spout is pushed back against the carton. This type of carton system is more costly not only because of the cost of the spout and overwrap or tape, but also because production line speeds are relatively low due to the need to incorporate the spout into the carton and overwrap the carton or apply the pressure sensitive tape.

In still another reclosable carton system in wide use today for dry cereals, for example, the carton includes top major end panels or flaps which are not as wide as the width of the carton and which overlap for only a portion of their respective widths. There are no weakened regions in the exterior of the carton and the top major end panels are spot glued to each other so that they may be easily separated to provide the easy opening feature. The major panels in this type of carton may include structure which interlocks them together after the initial opening of the carton to thereby provide the reclosable feature.

Cartons which incorporate an easy opening feature and/or a reclosable feature are disclosed in U.S. Pat. Nos. 1,553,752 (Cooper); 3,181,767 (Starkey); 3,262,630 (Koolnis); 3,270,941 (Barnes); 3,395,848 (Johnson); 3,426,955 (Olsen); 3,606,133 (Meyers); 3,897,900 (Gorski et al.); 4,019,673 (Salomons); 4,122,948 (Griev et al.): 4,142,635 (Capo et al.); 4,168,003 (Wysocki); 4,421,236 (Lowe); and 4,548,318 (Boyle).

The inventive carton disclosed herein includes structure defining an easy opening feature, and yet the carton is relatively strong prior to the initial opening to maintain product integrity during shipping, handling and sale, and also may include structure for reclosing the carton to maintain product freshness and/or prevent product contamination or spillage after the initial opening.

OBJECTS AND SUMMARY OF THE INVENTION

It is an object of the present invention to provide an improved easy opening carton.

It is a further object of the present invention to provide an improved reclosable carton.

It is also an object of the present invention to provide an improved easy opening, reclosable carton.

It is another object of the present invention to provide an easy opening and preferably reclosable carton which is substantially as strong as the same carton without the structure providing the easy opening feature.

It is another object of the present invention to provide an easy opening and preferably reclosable carton from a sheet-like blank, preferably from a one-piece paperboard blank.

It is another object of the present invention to provide an easy opening and preferably reclosable carton which may be manufactured easily and inexpensively.

It is another object of the present invention to provide blanks, preferably of one piece, from which such cartons may be made.

The present invention achieves the above and other objects by providing an easy opening carton in which structure incorporating the easy opening feature is not disposed in an exposed outer surface of the carton, and by providing a carton blank from which such a carton may be made. At least one weakened region is disposed in at least one end panel of the carton and is fully covered by another end panel so that it is not in an exposed outer surface of the carton. The other end panel may be separated from the one end panel by, for example, unfolding or pivoting the other end panel and thereby exposing the weakened region or regions which may then be at least partially severed to form an opening into the interior of the carton. The weakened region or regions are defined by at least one weakened portion which, when exposed, may be torn, penetrated or severed to at least partially sever the weakened region from the one end panel and form an opening into the carton. Since the weakened region or regions are fully covered by the other end panel prior to the initial opening of the carton, they are not located in an exposed exterior surface of the carton.

According to one embodiment, one end panel with a weakened region may overlay or be covered by a similar end panel which includes either an open region or another weakened region disposed in an overlaying relationship with the weakened region of the one end panel. The weakened region of the one end panel and the open or weakened region of the similar end panel are then fully covered by the other end panel. The one end panel may be referred to as a first end panel, the other end panel as a second end panel, and the similar end panel as a third end panel.

To open the carton, the second end panel covering the weakened region of the first end panel (and the open or weakened region of the third panel) is unfolded to expose an open region and/or at least one weakened region, and the weakened region or regions are then at least partially severed to form (with the open region if one is used) the opening into the carton. Preferably, the second end panel is sealed to another part of the carton in a manner which permits it to be unsealed easily.

Further in accordance with the invention, means are provided for connecting the second end panel to the first and/or third end panels in a manner which permits repeated opening and reclosing of the carton, thereby providing the reclosable feature.

The carton comprises ends and sides, and the end of the carton incorporating the easy opening structure comprises at least the first, second and third end panels, which are connected to respective ones of side panels that form the carton sides. The first and third end panels are connected to opposite side panels at opposite sides of the carton, each extending at least partially across the end of the carton towards the opposite carton side so that substantial parts of the first and third panels are in an overlaying relationship. The first end panel includes a first region which is the weakened region referred to above. The first region is disposed adjacent a first side of the first end panel adjacent and underlying the second end panel. The third end panel includes a second region which is the open or weakened region referred to above which is in an overlaying relationship with the first region. The second region is disposed adjacent a first side of the third end panel adjacent and underlying the second end panel. The second end panel extends over and fully covers at least the outer of, and preferably both of, the first and second regions so that neither of these regions is in an exposed outer surface of the carton.

According to a preferred embodiment of the invention, the sides and ends of the carton are rectangular and are formed by respective panels which define a rectangular parallelepiped. The first, second and third end panels are connected at respective ends thereof by, for example, weakened portions, e.g., scoring, to first, second and third side panels, respectively. The first and third end panels extend from the first and third side panels, respectively, substantially to the third and first side panels, respectively, in an overlaying relationship. In other words, one of the first and third end panels overlays the other for substantially the width of the carton. Such an overlaying relationship provides strength to the carton. The second end panel is pivotably connected by, for example, a weakened portion to the second side panel and extends partially over the first and third ends panels. In a specific embodiment, the carton has major and minor sides defined by major and minor panels, and major and minor end panels or flaps, of which the first and third end panels are major end panels, the second end panel is a minor end panel, the first and third side panels are major panels and the second side panel is a minor side panel.

The first region of the first end panel is at least partially defined by at least one weakened portion in which the first end panel is at least partially cut through, for example, by perforations, a nick cut or a kiss cut. Preferably, the first region is defined entirely by at least partially cut-through weakened portions and may also be defined by an edge or edges (i.e., sides or ends) of the first end panel. The second region of the third end panel, when it is a weakened region as discussed above, is at least partially defined by at least one weakened portion in which the second end panel is at least partially cut through. Preferably, the second region when a weakened region is defined entirely by at least partially cut-through weakened portions and may also be defined by an edge of edges of the third end panel.

Although it is preferred that the weakened region or regions be defined entirely by at least partially cut through weakened portions (and possibly an edge or edges of the respective panels) in order to facilitate complete severing of the weakened region or regions from the respective end panel, the weakened region or regions may partially be defined by non-cut through weakened portions such as score lines which maintain pivotable connection of the respective weakened region to the respective end panel after that region is severed at the cut-through portions. Preferably, the respective weakened region is less than the width between ends of the respective end panel to define an unweakened region at the first side of that end panel. This unweakened region strengthens the carton top as opposed to a weakened region which extends the full width of the respective end panel. Preferably, the respective weakened region is tapered to form a wedge-shaped opening, for example.

The carton further includes means adhering the second end panel to the outer end panel of the first and third end panels which permits the second end panel to be separated from the outer end panel and unfolded or pivoted to expose the outer of the first or second regions. Upon separating and pivoting the second end panel, at least one weakened region is exposed either as part of an outer end panel or through an open region of the outer end panel. The weakened region or regions may the be pushed in to at least partially sever it or them from the respective end panel to thereby form an opening into the carton.

The connecting means may be associated with the second end panel and at least one of the first and third end panels for connecting the second end panel to either or both of the first and third end panels such that the second end panel may be repeatedly disconnected from and reconnected to either or both of the first and third end panels. According to a preferred embodiment, the connecting means comprises a tap at the free end (i.e., the end opposite the one connected to the second side panel) of the second end panel and structure on one of the first and third end panels for receiving the tab. The receiving structure may comprise a slit or opening or similar open or pierced structure in one of the first and third end panels for receiving the tab. The connecting means may further comprise structure compatible with the receiving structure in the other of the first and third end panels which cooperates with the receiving structure. The compatible structure may comprise an opening, slit or other cooperating structure. The receiving means and compatible structure are disposed in an overlaying relationship and positioned so that the receiving structure receives the tab therein.

The adhering means may comprise a plurality of discrete separated areas in the form of closed figures containing glue. The glue in these areas, which are preferably circular, adheres the second end panel to the outer of the first and third end panels. Preferably, the separated areas are defined by weakened portions at least partially cut through the facing sides of either or both of the second and outer end panels. These separated, weakened portions facilitate separation of the second and outer end panels from each other and also substantially prevent delamination of those end panels except within the weakened areas. As a result, the reclosing function performed by these end panels is not substantially diminished.

A carton according to the invention may be formed from a sheet-like blank according to the invention, preferably a homogeneous, one-piece blank which includes the panels, the weakened portions, the weakened and/or open regions and the other structure described above.

The above and other objects, aspects, features and advantages of the present invention may be more readily perceived from the following description of the preferred embodiments thereof taken with the accompanying drawings and appended claims.

BRIEF DESCRIPTION OF THE DRAWINGS

The present invention is illustrated by way of example and not limitation in the figures of the accompanying drawings in which like references indicate like parts and in which:

FIG. 1 is a perspective view of one embodiment of an easy opening, reclosable carton according to the invention;

FIG. 2 is a perspective view of the upper portion of the carton of FIG. 1 depicted with the major and minor end panels open prior to closing and sealing thereof;

FIG. 3 is a perspective view of the upper portion of an easy opening, reclosable carton according to another embodiment of the invention in which one of the top major end panels is modified as compared to the corresponding panel of the carton of FIG. 1, the carton being depicted with the major and minor end panels open prior to closing and sealing thereof;

DESCRIPTION OF THE PREFERRED EMBODIMENTS

Figure 6:
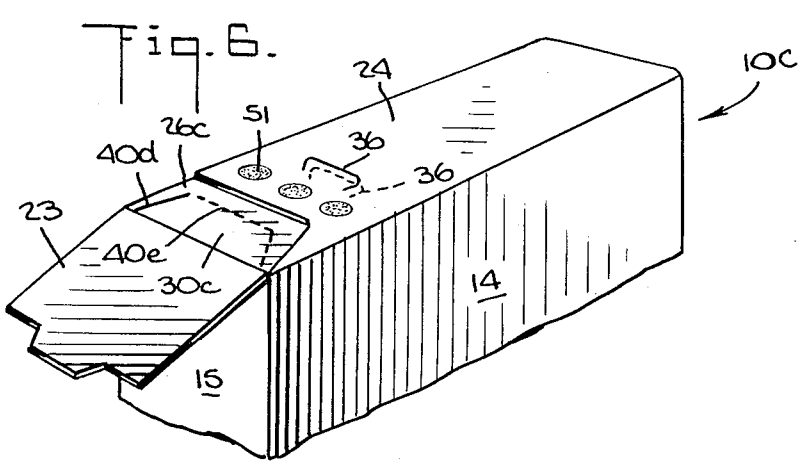
FIG. 6 is a perspective view of the upper portion of an easy opening, reclosable carton according to another embodiment of the invention in which one of the top major end panels is modified as compared to the corresponding panel of the carton of FIG. 1 and in which the order of folding the end panels is changed from the order for the carton of FIG. 1, the carton being depicted with the two major end panels and one minor end panel closed and sealed and one minor end panel open prior to sealing thereof.

An easy open, reclosable carton 10 in accordance with the invention is depicted in its closed and sealed configuration in FIG. 1. Carton 10 includes first, second, third and fourth side panels 14, 15, 16 and 17, a top end 19 and a bottom end 21. Top end 19 is formed by first and third major end panels or flaps 24 and 26 (only major end panel 24 being visible in FIG. 1), and minor second and fourth end panels or flaps 23 and 25 (only minor end panel 23 being visible in FIG. 1). As depicted in FIG. 2, each of the top end panels 23, 24, 25 and 26 is connected at a respective end thereof to side panels 15, 14, 17 and 16, respectively. Bottom end 21 is also formed by major and minor end panels (not shown). Carton 10 includes in top end 19 structure incorporating an easy opening feature and a reclosable feature which are described below.

Referring to FIG. 2, tab or projection 28 of minor end panel 23, weakened region 30 and opening 32 of major end panel 26, and cut-away or open region 34 and slit 36 of major end panel 24 cooperate to provide the easy opening and reclosable features. Weakened region 30 of major end panel 26 is defined by weakened portions illustrated by lines 40, which are at least partially cut through the panel, and by edge or first side 41 of major end panel 26.

The weakened portions illustrated by lines 40 are preferably formed by a nick cut in which the panel is fully cut through in the solid portions of lines 40 and is not cut through in the broken portions of lines 40. The length of the uncut portions may be selected in accordance with the relative strength desired for weakened region 30 (or conversely, the relative ease desired for severing weakened region 30). A weakened region 30 defined entirely by nick cut portions and panel edge 41 is presently preferred, however, weakened region 30 may also be formed by various combinations of weakened portions including perforations, kiss cuts, nick cuts and scoring, and panel edges, etc., so long as the major part of the weakened portions are at least partially cut through end panel 26 to facilitate at least partial severing of weakened region 30 from end panel 26.

Lines 40 extend from first side 41 of end panel 26 inwardly thereof. In the embodiment depicted in FIG. 2, line portions 40*a* and 40*b* extend at an angle to the opposed ends 43, 44 of the panel (i.e., generally diagonally) towards each other; however, portions 40*a* and 40*b* may also extend parallel to the opposed ends and to one another. One reason for extending line portions 40*a* and 40*b* at an angle to the panel ends, rather than parallel thereto, is that such diagonally extending weakened portions tear more easily than parallel weakened portions. Lines 40 in the embodiment of FIG. 2 include a third line portion 40*c* which extends transversely across end panel 26 from line portion 40*a* to line portion 40*b*. Lines 40 defines a generally U-shaped weakened portion. However, other configurations are acceptable, for example, a generally V-shaped weakened portion in which line portions 40*a* and 40*c* directly intersect each other. Line portion 40*b* extends from the vertex of rectangular major end panel 26 formed by the intersection of side 41 and end 44, while line portion 40*a* extends from a point inwardly of the vertex formed by the intersection of side 41 and end 43. There is thus an unweakened region 45 in end panel 26 adjacent line 40*a*. During opening of the carton, region 30 is completely severed from end panel 26 along lines 40, and an opening is created bounded by region 45 on one side and region 46 adjacent line portion 40*b* on the other side.

Major end panel 24 is shortened at first side 47 to define the open region 34 thereat. Panel 24 includes edge portions 47*a* and 47*b* extending between opposed ends 48, 49 thereof. Edges 47*a* and 47*b* extend at an angle to each other to define panel region 50 adjacent edge 47*a*. When end panels 24 and 26 are folded one over the other as depicted in FIG. 4, edge portion 47*a* of panel 24 extends along a line which is at or adjacent line portion 40*a* of end panel 26, and edge portion 47*b* of panel 24 extends along a line which is at or adjacent line portion 40*c* of end panel 26.

In the alternate embodiment depicted in FIG. 3, carton 10A includes major end panel 24A which includes a weakened region 30, similar to the region 30 in panel 26, rather than the open region 34 of end panel 24 of carton 10.

Figure 4:
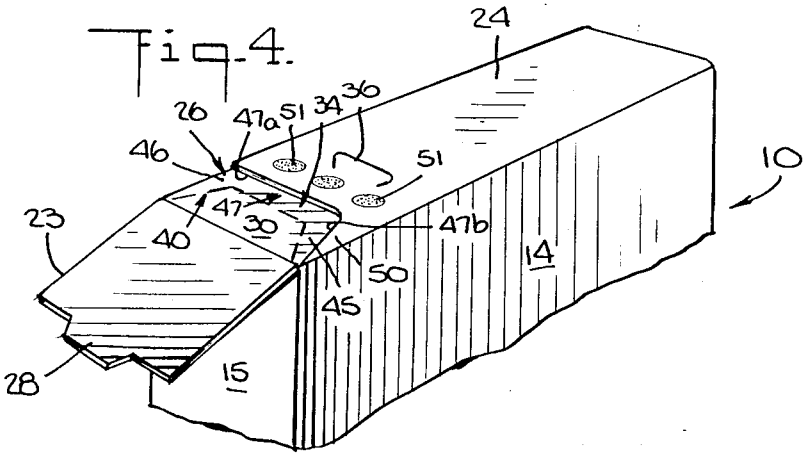
FIG. 4 is a perspective view of the upper portion of the carton of FIG. 1 depicted with the two top major end panels closed and sealed, one minor top end panel closed and the other minor end panel open prior to closing and sealing thereof.

FIG. 4 depicts carton 10 in its partially closed condition in which minor end panel 25 (not shown), has been folded first, then major end panel 26 (not shown), followed by folding of major end panel 24 over major end panel 26. Edges 47*a* and 47*b* of end panel 24 and lines 40 of end panel 26 are located relative to each other on the respective panels so that lines 40 are exposed when end panel 24 is folded over end panel 26. Located adjacent edge 47*b* of end panel 24 is region 50 which partially overlays region 45 of end panel 26. To complete closing and sealing of carton 10, minor end panel 23 is folded over major end panel 24 as depicted in FIG. 1. Major end panels 24 and 26 are glued together as will be described more fully in connection with the blank of FIG. 11, and minor end panel 23 is glued to major end panel 24 as discussed below. If desired, minor end panel 25 may be closed after major end panels 24 and 26, as depicted, for example, in the embodiment of FIG. 5.

To facilitate opening of minor end panel 23 after it has been glued to end panel 24, glue is applied to end panel 24 in discrete, separated, weakened regions 51 which are shaped as closed figures and formed in the embodiment of FIG. 4 by circular weakened portions in which end panel 24 has been partially cut through. By restricting glue to separated regions 51, not only is separation of end panel 23 from end panel 24 facilitated, but, in addition, board delamination is minimized when end panel 23 is separated from end panel 24. Preventing substantial delamination maintains the integrity of end panel 23 and end panel 24 adjacent slit 36, so that operation of the reclosable feature is not substantially diminished. Circular regions 51 may be located on end panel 23 instead of or in addition to circular regions 51 on panel 24.

Figure 5:
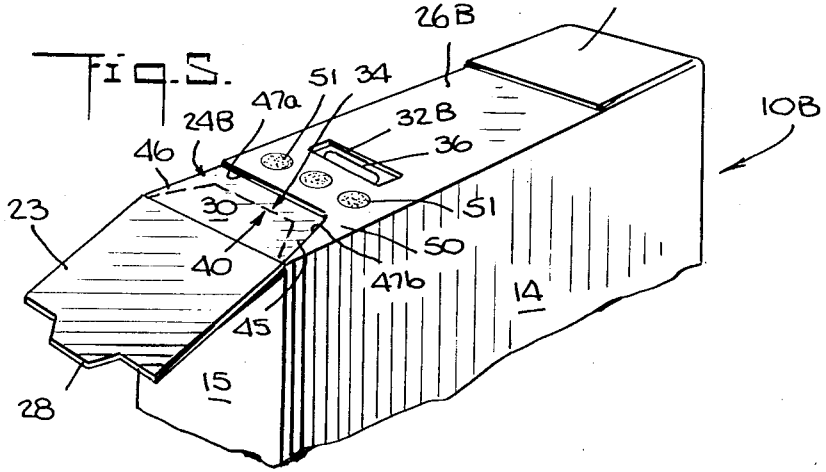
FIG. 5 is a perspective view of the upper portion of an easy opening, reclosable carton according to another embodiment of the invention in which one of the top major end panels is modified as compared to the corresponding panel of the carton of FIG. 1 and in which the order of folding the end panels is changed from the order for the carton of FIG. 1, the carton being depicted with the two major end panels and one minor end panel closed and sealed and one minor end panel open prior to sealing thereof.

Referring to FIG. 5, carton 10B is similar but not identical to carton 10 of FIG. 1. Specifically, carton 10B differs from carton 10 with respect to the order of closing minor end panel 25 and the major end panels, the location of circular glue areas 51, and the size of opening 32B. In carton 10B, major end panel 26B is closed after major end panel 24B, and is the outer end panel, and minor end panel 25 is closed after closing of the major end panels; circular glue areas 51 are disposed on major end panel 26B instead of major end panel 24B; and opening 32B is smaller than opening 32.

Another embodiment of an easy opening, reclosable carton is depicted in FIG. 6. Carton 10C of FIG. 6 is similar to carton 10 of FIG. 4 except that major end panel 26C of carton 10C includes a slit 36 instead of an opening 32 and a weakened region 30C which is defined by weakened portions including parts which are not at least partially cut through, e.g. a score line. Weakened portions illustrated by lines include score line 40*d* and perforations 40*e*. Weakened region 30C is thus stronger than weakened region 30 and is not intended to be completely severed from major end panel 26C. To open carton 10C, minor end panel 23 is pivoted open and weakened region 30C is pushed in to sever it along perforations 40*e*, but not along score line 40*d*. As a result, weakened portion 30C remains attached to end panel 26C within carton 10C.

Figure 7:
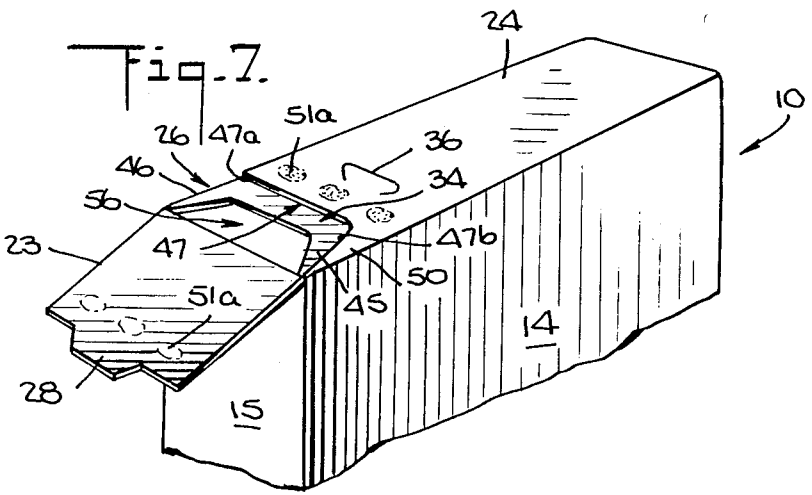
FIG. 7 is a perspective view of the upper portion of the carton of FIG. 1 depicted after opening with a minor end panel unsealed and opened to expose an opening into the carton formed from a weakened region in one of the major end panels which has been completely severed from that panel.

Opening and reclosing of carton 10 is described with reference to FIG. 7. Minor end panel 23 is separated from the outer of the major end panels (end panel 24) by grasping tab 28 and pulling. As discussed above, separation is facilitated by restricting glue to circular regions 51 so that any delamination occurs in unglued circular areas 51*a* on panels 23 and 24. After end panel 23 has been separated and pulled back as depicted in FIG. 7, weakened region 30 is pushed inwardly to completely sever it from major end panel 26 along lines 40. Severing region 30 from major end panels 26 as depicted in FIG. 7 forms a generally wedge-shaped opening 56. In an alternative embodiment (not shown), weakened region 30 may be glued to minor end panel 23 so that it tears when minor end panel 23 is unsealed and pivoted open. The contents of carton 10 may be removed through opening 56, which is at the top of the carton. Opening 56 is, therefore, fully visible during pouring and "blind-side" pouring is avoided. End panel 23 may also act as a pouring spout to assist in guiding the contents of the carton during pouring.

To reclose carton 10, end panel 23 is reclosed and tab 28 is inserted into slit 36. Opening 32 in end panel 24 which is below slit 36 facilitates insertion of tab 28 into slit 36. Structure other than tab 28, slit 36 and opening 32 may be used to interconnect end panel 23 to one of the other end panels. If desired, tab 28 may include a generally half-moon projection or recess which facilitates grasping of the tab during the initial and subsequent openings of the carton.

For carton 10A (FIG. 3) both weakened regions 30 are completely severed as described for carton 10 and pouring proceeds as for carton 10. Reclosing is as described for carton 10.

For carton 10B (FIG. 5) weakened region 30 is completely severed as described for carton 10, and pouring proceeds as for carton 10. To reclose carton 10B, end panel 23 is reclosed and tab 28 is inserted into slit 36 through opening 32B.

Carton 10C depicted in FIG. 6 includes, as discussed above, a weakened region 30C in major end panel 26C which is defined by weakened portions including a score line 40*d*. After minor end panel 23 is unsealed and pivoted open, weakened region 30C is pushed into the carton and partially severed. Carton 10C is reclosed by inserting tab 28 into both slits 36.

Cartons 10, 10A, 10B and 10C do not include any weakened or open regions in any exposed exterior panel or portion thereof. Specifically, minor end panel 23 fully covers any such weakened or open regions in the exterior of the major end panels. Thus, cartons 10, 10A, 10B and 10C are substantially not weakened in the unopened condition, as compared to cartons which have exposed weakened regions. In addition, unweakened regions 45 and 50 (FIG. 4) in end panels 26 and 24 respectively, are in an overlaying relationship to provide further rigidity to the carton in the vacinity of weakened region 30 and open region 34.

In still another embodiment, slit 36 may be provided in major end panel 24 and an opening 32 in major end panel 26 (not shown) so that the opening is below the slit as for carton 10, and weakened region 30 is above open region 34.

Figure 8:
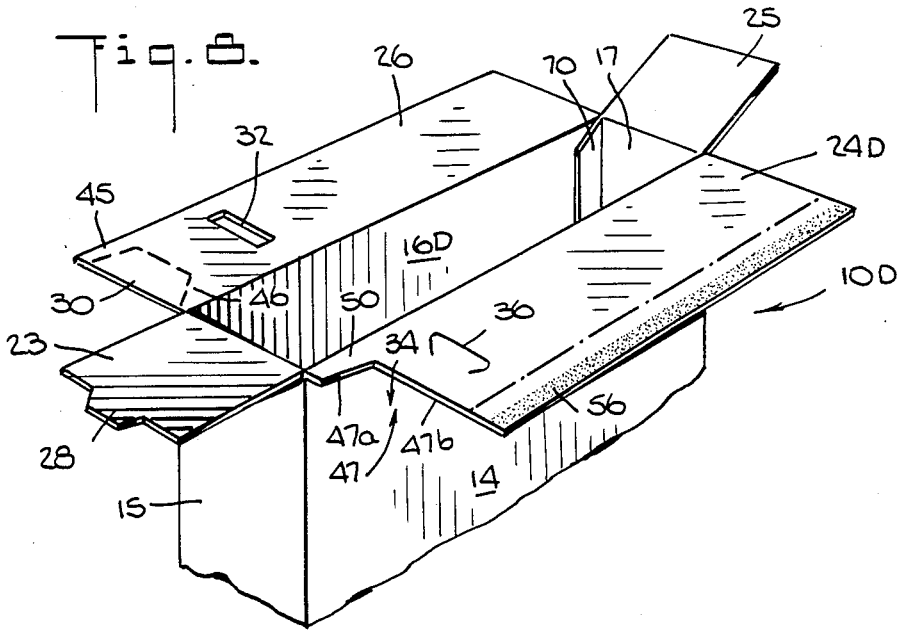
FIG. 8 is a perspective view of the upper portion of an easy opening, reclosable carton according to another embodiment of the invention in which one of the major end panels is modified as compared to the corresponding panel of the carton of FIG. 1 to include a glue flap, the carton being depicted with the major and minor end panels open prior to closing and sealing thereof.
Figure 9:
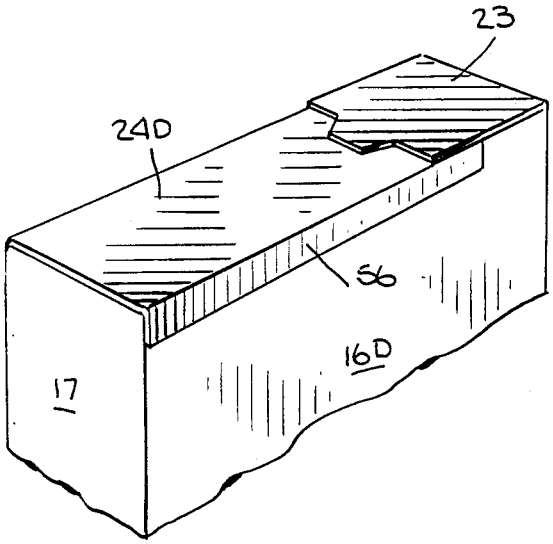
FIG. 9 is a perspective view of the upper portion of the carton of FIG. 8 with the major and minor end panels closed and sealed.
Figure 10:
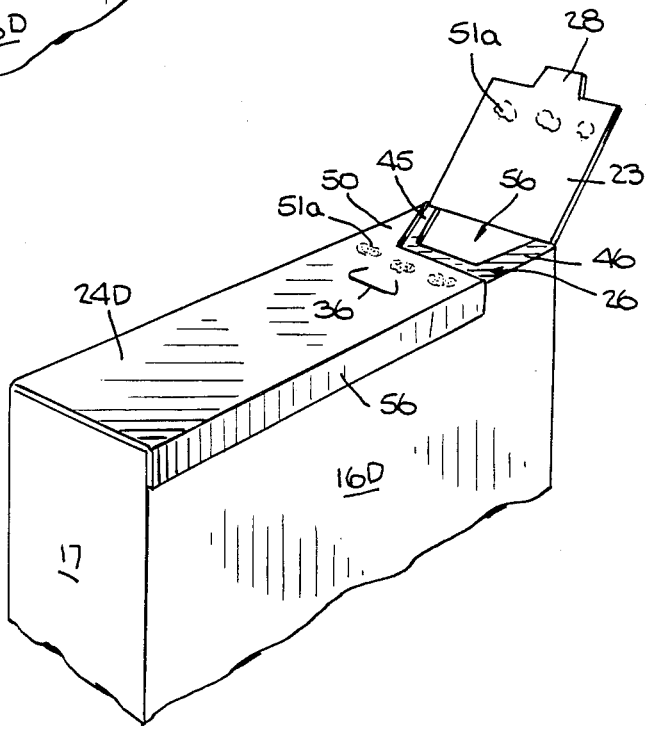
FIG. 10 is a perspective view of the upper portion of the carton of FIG. 8 depicted after opening with a minor end panel unsealed and opened to expose an opening into the carton formed by the partial severing of a weakened region in one of the major end panels.

FIG. 8 depicts another embodiment of an easy opening, reclosable carton 10D which differs from cartons 10, 10A, 10B and 10C in the configuration and manner in which the major end panels are glued. For cartons 10, 10A, 10B and 10C, major end panels 24 and 26 are glued together. For carton 10D, the outer major end panel, shown as end panel 24D in FIGS. 9 and 10, includes an edge portion or glue flap 56 which is glued to side 16D (FIG. 9) of carton 10D. Minor end panels 23 and 25, and major end panel 26 may be as described for carton 10 (or cartons 10A, 10B or 10C). Carton 10D is opened and reclosed as described for carton 10. Carton 10D is particularly applicable to smaller cartons, for example, those with small top areas which may present gluing problems at high sealing machine speeds. The gluing procedure is simplified for carton 10D since glue is not needed between major end panels 24 and 26, which avoids the more intricate gluing procedure required to deposit glue on facing surfaces of end panels 24 and 26.

Figure 11:
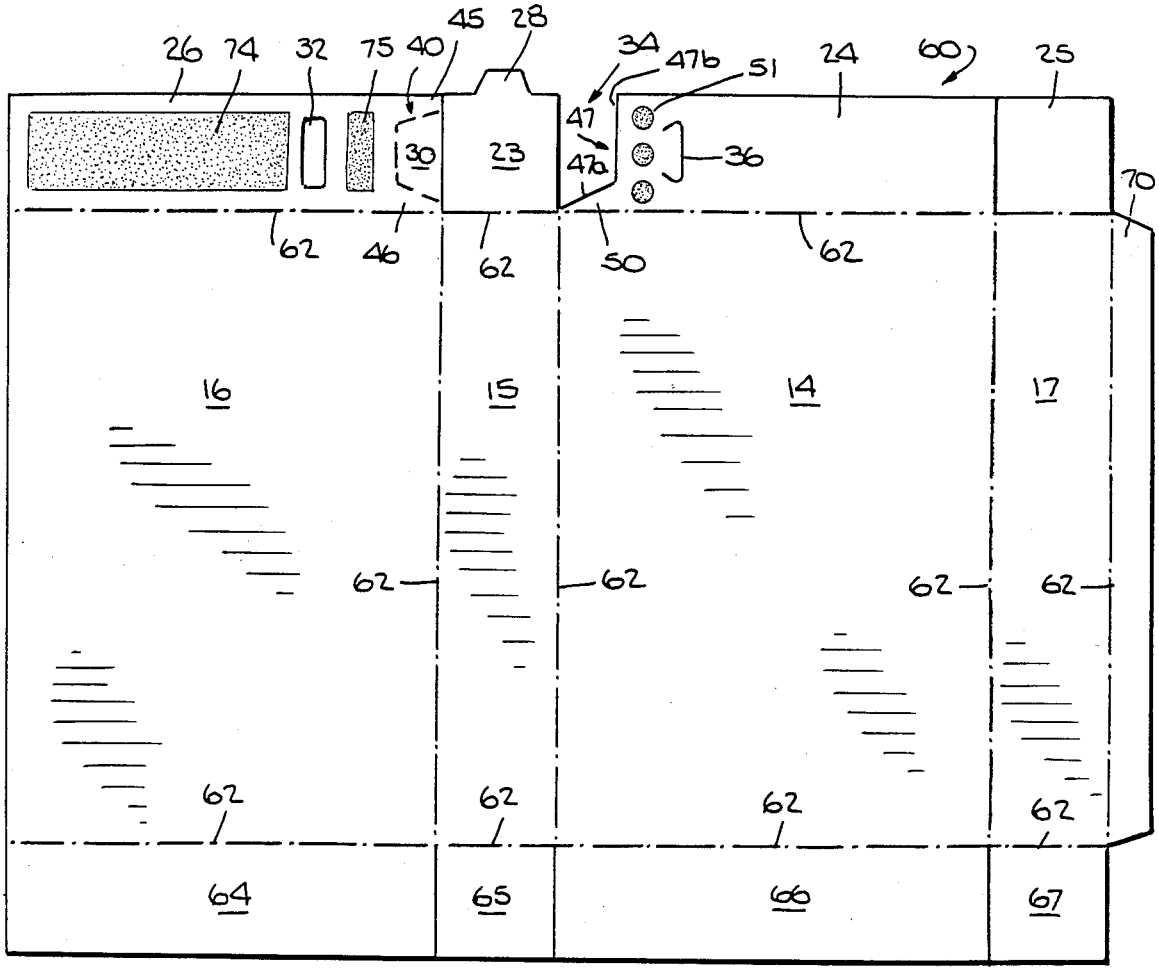
FIG. 11 is a plan view of a one-piece blank from which the carton of FIG. 1 may be formed.

Blank 60 depicts in FIG. 11 may be glued and folded to form carton 10 of FIG. 1. Blank 60 is a one-piece blank made of a homogeneous sheet material such as paperboard or other material and includes weakened regions 62 shown as broken lines along which blank 60 may be folded. Weakened regions 62 are preferably score lines dispsoed to define first, second, third and fourth side panels 14, 15, 16 and 17, respectively; first, second, third and fourth top end panels 24, 23, 26 and 27, respectively; and bottom end panels 64, 65, 66 and 67. In addition, one weakened region 62 defines a glue panel or flap 70 which is connected to side panel 17. The solid lines in FIG. 11 within blank 60 represent cuts which form sides of the end panels. The reference numbers in FIG. 11 correspond to those in FIGS. 1 and 2.

Glue is conventionally applied to bottom end panels 64–67 and to glue flap 70. Glue is also applied to selected regions of the top end panels in order to provide the easy opening, reclosable features. Specifically, glue is applied to regions 74 and 75 of major end panel 26 and to regions 51 of major end panel 24. Glue regions 74 and 75 of end panel 26 are disposed on the underside of end panel 26 as it is depicted in FIG. 2, and glue regions 51 are disposed on the underside of end panel 24 as it is depicted in FIG. 2. Optionally, glue may be applied to minor end panel 25 or major end panel 24 adjacent end panel 25, so that the top of end panel 25 will be glued to the bottom of end panel 24 with reference to the FIG. 1 configuration. Referring to FIG. 4, glue regions 74 and 75 are disposed between closed end panels 22 and 24, and, referring to FIG. 1, glue regions 51 are disposed between end panels 23 and 24. Alternatively, glue may be applied to the opposite facing panel surface rather than to the panel surfaces described above.

Blank 60 may be glued and erected with standard folding carton machinery as follows. First, flap 72 is glued and adhered to side panel 16 to form a flat knocked-down, partially assembled blank which may be shipped in that form to a location where it it will be filled with product. Prior to erection of carton 10 for filling, glue is applied to regions 51, 74, 75 and 76 (or glue previously applied to those regions is activated). Blank 60 is then folded along lines 62 to form a rectangular parallelepiped structure as depicted in FIG. 2, with top and bottom ends open. Thereafter, top end end panels 23, 24, 25 and 26 are folded as described in connection with FIGS. 2 and 4 and sealed together. The carton is then filled from the bottom end, and glue is applied to selected ones of the bottom end panels (or previously applied glue is activated) and the bottom end panels are clsoed and sealed conventionally. Blank 60 may also be glued and erected according to other procedures.

Cartons 10A, 10B, 10C and 10D are formed from blanks similar to blank 60 but differing in respects described above or apparent from the drawings. Glue is applied to such blanks in manners similar to that described for blank 60 and in accordance with the order of folding of the end panels.

Figure 12:
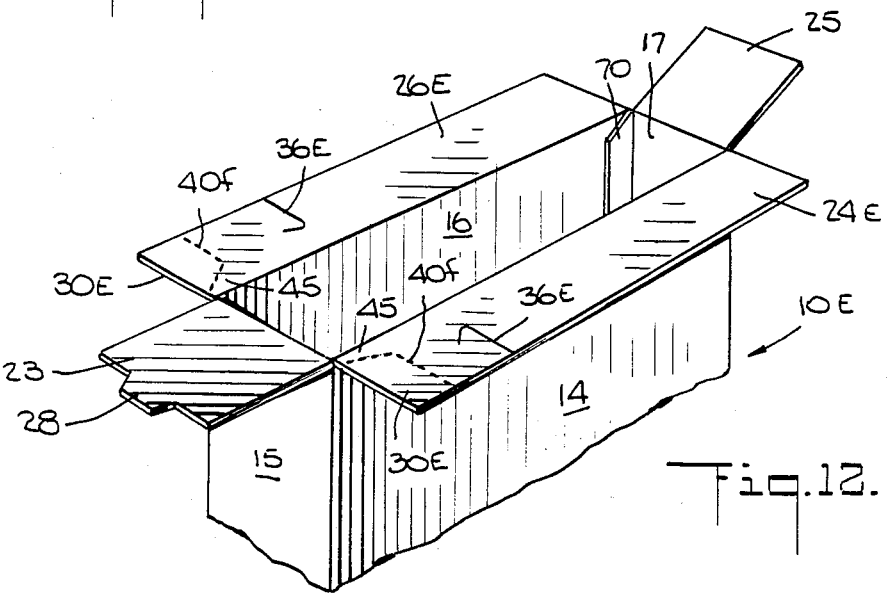
FIG. 12 is a perspective view of the upper portion of an easy opening, reclosable carton according to still another embodiment of the invention in which both major end panels are modified as compared to the corresponding panels of the carton of FIG. 1, the carton being depicted with the major and minor end panels open prior to closing and sealing thereof.
Figure 13:
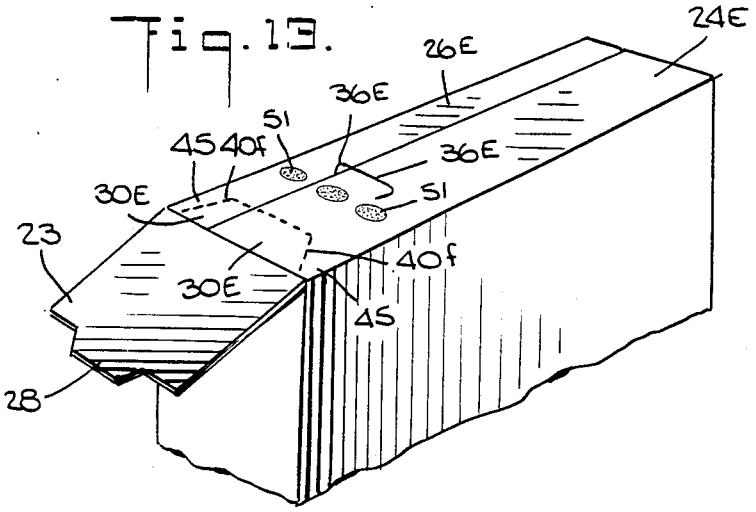
FIG. 13 is a perspective view of the upper portion of the carton of FIG. 12 depicted with both major end panels closed and sealed in a partially overlaying relationship, one minor end panel closed and the other minor end panel open.

Another embodiment of an easy opening, reclosable carton according to the invention is depicted in FIGS. 12 and 13. Carton 10E includes top major end panels 24E and 26E and top minor end panels 23 and 25 which are connected to respective side panels 14, 16, 15 and 17. Minor end panels 23 and 25 are as described for carton 10. Major end panel 24E and 26E differ from the corresponding major end panels of cartons 10, 10A, 10B, 10C and 10D in that they are narrower in width than the width of the carton, i.e. narrower than the width of the side panels 15, 17. As a result, when major end panels 24E and 26E are folded as depicted in FIG. 13, they do not overlap for substantially the entire width of the carton, but rather overlap for a substantial portion of the respective widths.

Structure forming an easy opening feature in carton 10E is incorporated in major end panels 24E and 26E adjacent to minor end panel 23, as for cartons 10 and 10A–D. Each of major end panels 24E and 26E includes a weakened region 30E. Each weakened region 30E is defined by a weakened portions **40*f* and side and end edges of the respective panel. Weakened portions 40*b* may be at least partially cut through or scored generally as described for cartons 10 and 10A–10D. However, it is preferred that the weakened portions 40*f* all are cut-through regions of the type described above so that each of weakened region 30E in major end panels 24E, 26E may be severed completely from the respective panel. Weakened regions 30E, as shown in drawings, are each defined by perforations and edges of the respective panels. The weakened portions do not extend from a vertex of the respective panel and, therefore, define regions 45 similar to that of carton 10**.

Major end panels 24E and 26E also include structure providing the reclosable feature. Specifically, with reference to FIG. 12, major end panels 24E, 26E each include a slit portion 36E which partially overlay each other when the major end panels are folded as depicted in FIG. 13. As a result, slit portions 36E define a slit as set in FIG. 13 similar to slit 36. As depicted in FIG. 13, each of major end panels 24E and 26E include discrete, circular, glue regions 51 for adhering minor end panel 23 thereto.

Minor end panel 23 is closed and sealed to major end panels 24E and 26E. As is the case for cartons 10 and 10A-10D, minor end panel 23 completely covers weakened regions 30E and slit portions 36E.

To unseal and open carton 10E, minor end panel 23 is unsealed and pivoted open to expose weakened regions 30E which are pushed into completely severe them from the respective major end panels. This produces an opening into the carton from which product may be dispensed. To reclose carton 10E, minor end panel 23 is pivoted closed and tab 28 thereof is inserted into slit portions 36E.

Figure 14:
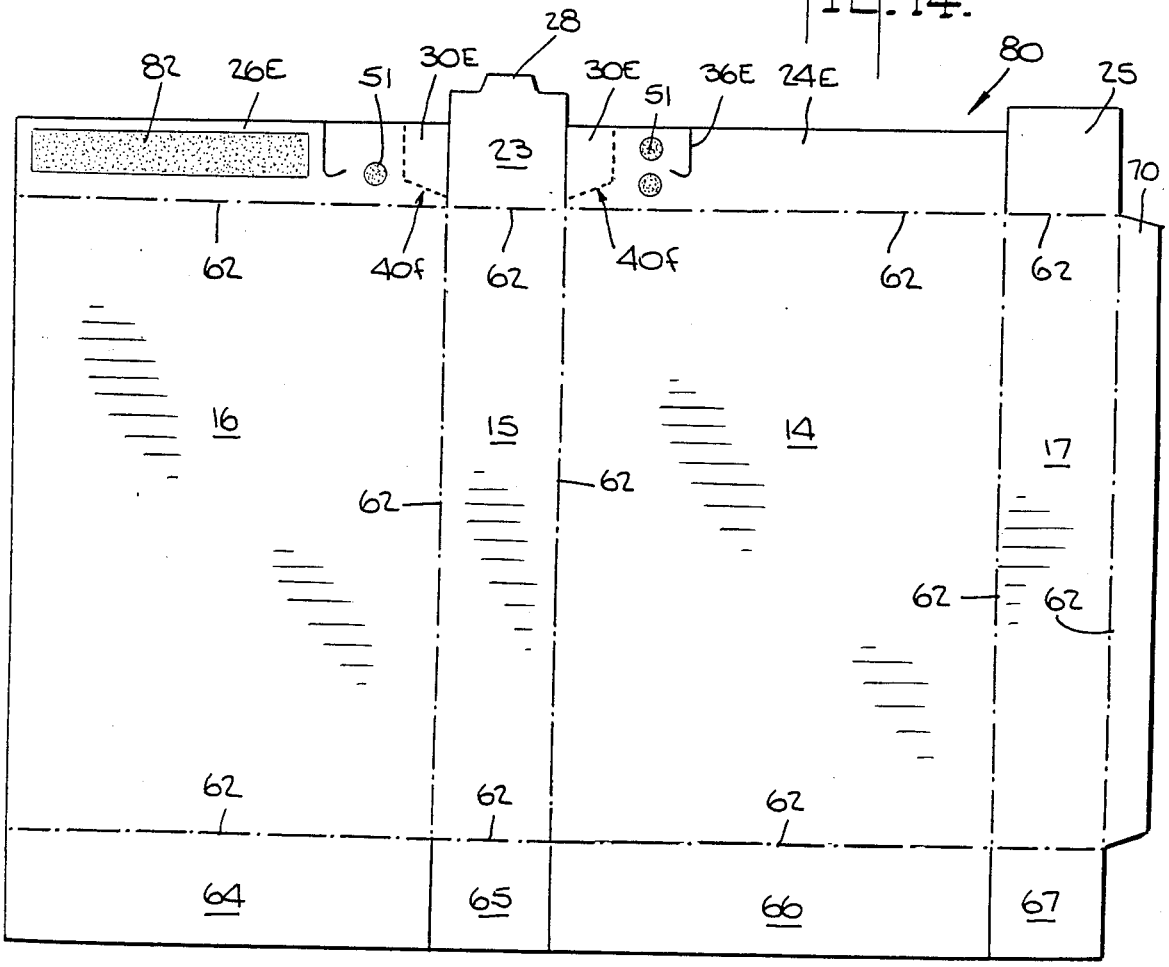
FIG. 14 is a plan view of a one-piece blank from which the carton of FIG. 12 may be made.

Referring to FIG. 14, blank 80 is depicted from which carton 10E may be fabricated. Blank 80 is similar to blank 10 except for major end panels 24E and 26E which are structured as described above. In blank 80, major end panels 24E and 26E are smaller in width than the width of the minor side panels 23 and 25. In addition, minor end panels 23 and 25 are longer in length than the width of the major end panels. However, the minor end panels need only have a length sufficient to cover the weakened regions and slit portions of the major end panels. Glue is applied to region 82 on major end panel 26E on the side thereof corresponding to the upper side depicted in FIG. 13. Glue is also applied to circular regions 51. Glue may also be applied to major end panel 24E adjacent minor end panel 25 or minor end panel 25 on the side respective thereof facing the other end panels when the minor end panel is folded first. Major end panels 24E and 26E are adhered together for substantially their entire lengths in the overlaying portions thereof.

The invention has been described and illustrated with respect to several preferred embodiments thereof. However, the invention is not intended to be limited to such embodiments, and it is intended that the claims cover all changes nd modifications to the preferred embodiments disclosed herein which may be readily apparent to those skilled in the art and which do not depart from the spirit and scope of the invention.

What is claimed is:

1. A sheet-like blank for forming an easy opening carton having side panels and end panels, the blank comprising at least four side panels and at least three end panels, first, second and third end panels being foldably connected to first, second and third side panels, respectively, the second side panel having an end connected to the second end panel and opposed sides, the first and third end panels each extending from the respective side panel a distance which is substantial compared to the width between opposed sides of the second side panel, each of the first, second and third end panels being defined by opposed ends and opposed sides, one of the ends of each of the first, second and third end panels being connected to a respective side panel, the first end panel having a first region proximate a first side thereof which is weakened and defined by at least one weakened portion in which the blank is at least partially cut through, the third end panel having or defining a second region proximate a first side thereof which is one of a weakened region defined by at least one weakened portion in which the blank is at least partially cut through and an open region, the first and second regions being of generally the same size and being disposed in generally corresponding locations relative to the respective first sides theeof and lying within given distances from the respective first side of the respective end panel, the second end panel extending a distance from the second side panel which is greater than each of the given distances.

2. The blank according to claim 1 wherein the first and third end panels each extend a same distance from the respective side panel which same distance is approximately equal to the width between opposed sides of the second side panel.

3. The blank according to claim 1 wherein the first and third end panels extend a same distance from the respective side panels which same distance is less than the width between opposed sides of the second side panel.

4. The blank according to claim 2 wherein the distance that the second end panel extends from the second side panel is said distance.

5. The blank according to claim 1 wherein the other of the opposed ends of the second end panel includes a projection and at least one of the first and third end panels includes structure therein for receiving the projection, the receiving structure being located a distance from the respective first side of the respective end panel approximately equal to the distance which the second end panel extends from the second side panel.

6. The blank accordance to claim 5 wherein the receiving structure is a slit in one of the first and third end panels, and the other of the first and third end panels without the slit has structure compatible with the slit therein disposed at a location thereof relative to the first end panel corresponding to the location of the slit and cooperating with the slit to permit the slit to receive the projection.

7. The blank according to claim 1 including additional weakened portions in which the blank is at least partially cut through which define a plurality of discrete, separated, substantially closed figures disposed in at least one of the first and third end panels adjacent the respective first or second region thereof.

8. The blank according to claim 1 wherein the first region is defined by weakened portions spaced from each other at the first side of the first end panel which extend therefrom inwardly of the first end panel towards each other, thereby defining a first region which tapers as it extends from the first side of the first end panel.

9. The blank according to claim 8 wherein the first region is narrower at the first side of the first panel than the width between opposed ends of the first panel.

10. The blank according claim 9 wherein the second region is an open region extending from an end of the second end panel to short of the opposed end thereof to define a narrow panel region extending adjacent the first side and opposed end of the third end panel.

11. The blank according to claim 9 wherein the second region is defined by weakened portions spaced from each other at the first side of the third end panel which extend therefrom inwardly of the third end panel towards each other, thereby defining a second region which tapers as it extends from the first side of the third end panel.

12. The blank according to claim 11 wherein the second region is narrower at the first side of the third end panel than the width between opposed ends of the third end panel.

13. The blank according to claim 1 wherein the first and second regions are each defined by weakened portions extending from a first side of the respective panel inwardly and then laterally to the end of the respective panel opposite the end connected to a respective side, thereby defining a weakened region including an adjacent end and side of the respective panel.

14. A sheet-like blank for forming an easy open carton, the blank comprising weakened portions which facilitate bending of the blank to form a rectangular parallelepiped carton, the weakened portions being disposed to define at least four adjacently disposed generally rectangular side panels which form sides of the carton when the blank is folded to form the carton, and at least three generally rectangular end panels which form an end of the carton when the blank is folded to form the carton, each of the first, second and third end panels being defined by opposed ends and opposed sides, a first of the end panels being connected at an end thereof by a weakened portion to a first of the side panels, a second of the end panels being connected at an end thereof by a weakened portion to a second of the side panels, a third of the end panels being connected at an end thereof by a weakened portion to a third of the side panels, the second side panel having an end connected to the second end panel and opposed sides, the width between opposed sides of the second side panel defining the width of the carton, the first and third end panels each extending from the respective side panel a distance which is substantial compared to the width of the second side panel whereby when the blank is folded to form the carton the first and third end panels are in an overlaying relationship for a substantial portion of the width of the carton, the first end panel having a first region proximate a first side thereof which is weakened and is defined by at least one weakened portion in which the blank is at least partially cut through, the third end panel having or defining a second region proximate a first side thereof which is one of a weakened region defined by at least one weakened portion in which the blank is at least partially cut through and an open region, the first and second regions being of generally the same size and being disposed in generally corresponding locations relative to the second end panel such that when the blank is folded to form the carton they are in an at least partially overlaying relationship, the second end panel extending a distance from the second side panel and the first and second regions being located such that the second end panel overlays and covers all of the first and second regions when the blank is folded to form the carton.

15. The blank according to claim 14 wherein the first and third end panels each extend a same distance from the respective side panel which same distance is approximately equal to the width between opposed sides of the second side panel.

16. The blank according to claim 14 wherein the first and third end panels extend a same distance from the respective side panels which same distance is less than the width between opposed sides of the second side panel.

17. The carton according to claim 14 including connecting means associated with the second end panel and at least one of the first and third end panels for connecting the second end panel to at least one of the first and third end panels when the blank is folded to form the carton, the connecting means permitting, when the blank is folded to form the carton, repeated disconnecting and reconnecting of the second end panel to the at least one end panel.

18. The blank according to claim 17 wherein the connecting means includes a tab projecting from the end of the second end panel opposite the end connected to the second side panel and a slit in at least one of the first and third end panels, the slit being sized and located to receive the tab when the blank is folded to form the carton.

19. The blank according to claim 18 wherein the connecting means includes an opening in the other of the first and third end panels without the slit, the opening being disposed in a location of the other end panel relative to the second end panel when the blank is folded to form the carton corresponding to the location of the slit, whereby the slit and opening are in an overlaying relationship when the blank is folded to form the carton.

20. The blank according to claim 14 including additional weakened portions in which the blank is at least partially cut through which define a plurality of discrete, separated, substantially closed figures disposed in at least one of the first and third end panels adjacent the respective first or second region thereof.

21. The blank according to claim 14 wherein the first region is defined by weakened portions spaced from each other at the first side of the first end panel which extend therefrom inwardly of the first end panel towards each other, thereby defining a first weakened region which tapers as it extends from the first side of the first end panel.

22. The blank according to claim 21 wherein the first region is narrower at the first side of the first end panel than the width between opposed ends of the first panel.

23. The blank according to claim 21 wherein the second region is an open region extending from an end of the second end panel to short of the opposed end to define a narrow panel region extending adjacent a first side and the opposed end of the third end panel.

24. The blank according to claim 21 wherein the second region is defined by weakened portions spaced from each other at the first side of the third end panel which extend therefrom inwardly of the third end panel towards each other, thereby defining a second region which tapers as it extends from the first side of the third end panel.

25. The blank according to claim 24 wherein the second region is narrower at the first side of the third end panel than the width between opposed ends of the third end panel.

26. The blank according to claim 14 wherein the first and second regions are each defined by weakened portions extending from a first side of the respective panel inwardly and then laterally to the end of the respective panel opposite the end connected to a respective side, thereby defining a weakened region including an adjacent end and side of the respective panel.

27. A knocked-down blank of sheet-like material from which an easy open carton having side panels and end panels may be formed, the blank comprising first, second, third and fourth adjacently disposed side panels and means foldably connecting each side panel to two adjacent side panels, two adjacent side panels being in an overlying relationship with two other adjacent side panels in the flat, knocked-down condition of the blank, first, second and third end panels foldably connected to first, second and third side panels, respectively, such that two of the first, second and third end panels are in an overlaying relationship with the remaining end panel in the knocked-down condition of the blank, the second side panel having an end connected to the second end panel and opposite sides connected to adjacent side panels, the first end panel having a first region disposed proximate the second end panel, the first region being weakened and being defined by at least one weakened portion in which the blank is at least partially cut through, the third end panel having or defining a second region proximate the second end panel, the second region being one of a weakened region defined by at least one weakened portion in which the blank is at least partially cut through and an open region, the first and second regions being of generally the same size and being disposed in generally corresponding locations relative to the second end panel, the first and third end panels extending from respective side panels a distance which is substantial compared to the width between opposed sides of the second side panel, the first and second regions lying within given distances from the second end panel, and the second end panel extending a distance from the second side panel which is greater than the given distances.

28. The blank according to claim 27 wherein the first and third end panels each extend a same distance from the respective side panel which same distance is approximately equal to the width between opposed sides of the second side panel.

29. The blank according to claim 27 wherein the first and third end panels extend a same distance from the respective side panels which same distance is less than the width between opposed sides of the second side panel.

30. The blank according to claim 27 wherein the second end panel includes opposed ends one of which is connected to the second side panel, and wherein the second end panel includes a projection at the other of the opposed ends, at least one of the first and third end panels has a slit therein sized to receive the projection, the slit being located a distance from the respective first side of the respective panel corresponding to the distance of the projection from the second side panel.

31. An easy opening carton comprising sides and ends defining a rectangular parallelopiped, the sides being formed by side panels and the ends by end panels, one of the carton ends comprising first, second, and third end panels which are connected to first, second and third side panels, respectively, the first and third end panels extending from the first and third side panels, respectively, a substantial distance towards the third and first side panels, respectively, in an at least partially overlaying relationship, the second end panel being pivotably connected to the second side panel and extending partially over the first and third end panels, the first end panel including a first region which is weakened and is defined by at least one weakened portion in which that end panel is at least partially cut through, the third end panel having or defining a second region which is one of a weakened region defined by at least one weakened portion in which that panel is at least partially cut through and an open region, the first and second regions being disposed in an overlaying relationship adjacent the second end panel, the second end panel fully overlaying at least the outer of the first and second regions in the outer of the first and third end panels, respectively, and means adhering the second end panel to the outer end panel which permits the second end panel to be separated from the outer end panel and pivoted to expose the outer of the first and second regions.

32. The carton according to claim 31 wherein the second side panel has an end connected to the second end panel and opposed sides connected to adjacent side panels, and wherein the first and third end panels each extend a same distance from the respective side panel which same distance is approximately equal to the width between opposed sides of the second side panel.

33. The blank according to claim 31 wherein the second side panel has an end connected to the second end panel and opposed sides connected to adjacent side panels, and wherein the first and third end panels extend a same distance from the respective side panels which same distance is less than the width between opposed sides of the second side panel.

34. The carton according to claim 31 including connecting means associated with the second end panel and at least one of the first and third end panels for connecting the second end panel to the one end panel and permitting repeated disconnecting and reconnecting of the second end panel to the one end panel.

35. The carton according to claim 34 wherein the second end panel has a free end opposite to an end connected to the second side panel and wherein the connecting means comprises a tab connected to the free end of the second end panel, a slit in at least one of the first and third end panels and compatible structure in the other of the first and third end panels, the slit and the compatible structure being disposed in an overlaying relationship positioned to receive the tab therein.

36. The carton according to claim 31 wherein the first end panel has opposed ends one of which is connected to the first side panel and wherein first region is less in width than the width between ends of the first end panel to define an unweakened region in the first end panel adjacent an end of the first and panel.

37. The carton according to claim 31 including additional weakened portions in which the carton is at least partially cut through defining a plurality of discrete, separated, substantially closed figures located in one of the first and third end panels adjacent the respective first or second region thereof, and glue disposed in the additional weakened regions for adhering the second end panel thereto.

38. The carton according to claim 31 wherein the weakened portions defining the first region include weakened portions spaced from each other at a first side of the first end panel adjacent the second side panel which extend therefrom inwardly of the first end panel towards each other, whereby defining a first region which tapers as it extends from the first side of this first end panel.

39. The carton according to claim 38 wherein the first region is narrower at the first side of the first panel than the width between ends of the first end panel.

40. The carton according to claim 39 wherein the second region is an open region extending from a free end of the second end panel to short of an opposed end thereof to define a narrow panel region extending adjacent the first side and an end of the third end panel.

41. The carton according to claim 38 wherein the second region is defined by weakened portions spaced from each other at a first side of the third end panel adjacent the second side panel which extend therefrom inwardly of the third end panel towards each other, thereby defining a second region which tapers as it extends from the first side of the third end panel.

42. The carton according to claim 41 wherein the second region is narrower at the first side of the third end panel than the width between ends of the third end panel.

43. The carton according to claim 31 wherein the first and second regions are each defined by weakened portions extending from a first side of the respective panel inwardly and then laterally to the end of the respective panel opposite to the end connected to a respective side, thereby defining a weakened region including an adjacent end and side of the respective panel.

* * * * *